United States Patent [19]

Bell

[11] Patent Number: 5,071,272

[45] Date of Patent: Dec. 10, 1991

[54] RIBBON CASSETTE AND PROTECTOR

[75] Inventor: Jeffrey D. Bell, Munfreesboro, Tenn.

[73] Assignee: Pelikan, Inc., Franklin, Tenn.

[21] Appl. No.: 565,996

[22] Filed: Aug. 10, 1990

[51] Int. Cl.[5] ..... B41J 35/28; B41J 35/26

[52] U.S. Cl. ..... 400/208; 400/247

[58] Field of Search ..... 400/207, 208, 247, 248, 400/248.1, 208.1

[56] References Cited

U.S. PATENT DOCUMENTS

| | | | |
|---|---|---|---|
| 4,383,775 | 5/1983 | Trammell et al. | 400/208 |
| 4,408,912 | 10/1983 | Yonkers | 400/208 |
| 4,422,785 | 12/1983 | Shore | 400/208 |
| 4,496,256 | 11/1985 | McMorrow et al. | 400/248 |
| 4,676,681 | 6/1987 | Kilkuchi et al. | 400/247 |
| 4,856,923 | 8/1989 | Smith | 400/247 |
| 4,904,098 | 2/1990 | Hamilton | 400/248 |

FOREIGN PATENT DOCUMENTS

| | | | |
|---|---|---|---|
| 0288958 | 11/1988 | European Pat. Off. | 400/247 |
| 0100183 | 7/1980 | Japan | 400/248 |
| 0083174 | 4/1987 | Japan | 400/248 |

OTHER PUBLICATIONS

IBM Technical Disclosure Bulletin, vol. 16, No. 3, Aug. 1973.

*Primary Examiner*—Edgar S. Burr
*Assistant Examiner*—Christopher A. Bennett
*Attorney, Agent, or Firm*—John F. A. Earley; John F. A. Earley, III

[57] ABSTRACT

A ribbon cassette has a rectangular clip and a mushroom clip on its guide arms for detachably mounting a ribbon protector which has a rectangular slot that attaches to the rectangular clip and allows some lateral and back and forth movement of the ribbon protector, and has a starburst hole with leaves that attach to the mushroom clip for detachably holding the ribbon protector on the cassette and for positioning a central print hole in the protector in a central space between the ribbon guide arms of the cassette.

3 Claims, 2 Drawing Sheets

RIBBON CASSETTE AND PROTECTOR

BACKGROUND OF THE INVENTION

1. Field of the Invention

The present invention relates to ink ribbon cassettes and protectors for use in printers.

2. Description of the Prior Art

It is conventional to use ink ribbon cassettes, which house an endless ink ribbon, in printers. The cassette is mounted on the printer carriage, and is easily installed without smearing the hands of the operator and the parts of the printer. Such an ink ribbon cassette is shown in U.S. Pat. No. 4,676,681 which is incorporated herein by reference, and which shows projections or pins 7*a*, 7*b* and holders 9*a*, 9*b* for detachably mounting a ribbon protector 10 which has oblong holes 10*a*, 10*b* that are inserted over pins 7*a*, 7*b*. Pin 7*a* is longer than the distance between the surface of ribbon guide arm 2*a* and holder 9*a* so the oblong hole 10*a* of protector 10 cannot fall off the pin 7*a*. Similarly, pin 7*b* is longer than the distance between the surface of ribbon guide arm 2*b* and the holder 9*b* so the oblong hole 10*b* of at the other end of protector 10 cannot fall off the pin 7*b*.

Another example of a ribbon cassette and protector is shown in U.S. Pat. No. 4,383,775 wherein the ribbon protector is mounted on the cassette by fixing it in slits in the ink ribbon cassette or by bonding it to the ink ribbon cassette. U.S. Pat. No. 4,383,775 is also incorporated herein by reference.

If the ribbon protector is fixed to the ink ribbon cassette, it cannot move between the ink ribbon and the paper sheet being printed upon, and therefore it has to be positioned very accurately, which is time-consuming and laborious. Also, ribbon protectors which are fixed to the cassette cannot be easily replaced with a new protector.

SUMMARY OF THE INVENTION

It is an object of this invention to provide a ribbon protector and an ink ribbon cassette on which the ribbon protector is easily mounted, detached, and replaced.

The ink ribbon cassette of this invention has two ribbon guide arms that are separated by a central printing space and is provided with a rectangular clip mounted on one ribbon guide arm, and a mushroom clip mounted on the other ribbon guide arm of the cassette. The rectangular clip has an overhanging lip, and the mushroom clip has a circular overhanging lip.

The ribbon protector has a central printing hole, and it also has a rectangular hole for attaching to the rectangular clip to hold the protector on the cassette and yet permit some lateral and back and forth movement of the protector. The ribbon protector also has a starburst hole that has leaves that extend under the mushroom clip lip to properly position the central printing hole of the protector in the printing space between the ends of the ribbon guide arms.

The central portion of the ribbon protector is movable back and forth because the rectangular hole fits loosely over the rectangular clip, so that the ribbon protector automatically adjusts to a desired position between the sheet of paper being printed upon and the ink ribbon.

DETAILED DESCRIPTION

Figure 1:
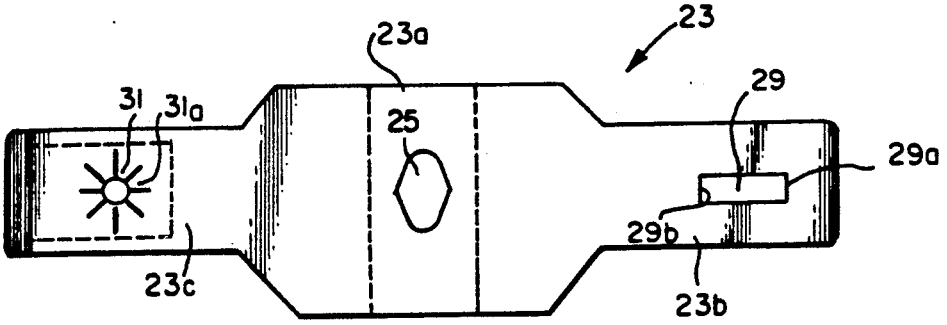
FIG. 1 is a view in front elevation of a ribbon shield or protector made of a clear polyester plastic constructed in accordance with this invention.

Referring to the drawings, an ink ribbon cassette 11 is provided for printing on a paper sheet 12 which is mounted on a platen 14. Ribbon cassette 11 includes a case 13 which houses an endless ink ribbon 15, and a cover 17 which is mounted on case 13 to enclose the case and its contents. Case 13 has a pair of ribbon guide arms 19, 21 which guide the ink ribbon 15 into and out of the ribbon case. Ribbon guide arm 19 has a front surface 19*a* and ribbon guide arm 21 has a front surface 21*a*.

An elongated ribbon protector 23 is formed of a sheet of resiliently bendable material, and is preferably made from a sheet of clear polyester. Ribbon protector 23 is detachably mounted on the ribbon guide arms 19, 21 in order to cover the exposed portion of the ink ribbon 15 as it passes through a central space 24 between the ribbon guide arms 19 and 21.

A central print hole 25 is formed in the central portion 23*a* of the protector 23 for positioning a print head 27 therein.

A rectangular hole or slot 29 is formed in one end portion 23*b* of the protector 23, and a starburst hole 31 having leaves 31*a* is formed in the other end portion 23*c* of the protector 23.

Means are provided on the case 13 for positioning the ribbon protector 23 on the front surfaces 19*a*, 21*a* of the ribbon guide arms 19, 21 and for detachably holding the ribbon protector 23 on front surfaces 19*a*, 21*a*. Such means include a rectangular clip 33 formed on front surface 19*a* of ribbon guide arm 19, and a mushroom clip 37 formed on front surface 21*a* of ribbon guide arm 21. The clip 33 has a head portion 33*a* and a smaller stem portion 33*b*, and the head portion 33*a* has an overhanging lip 33*c* which forms a slot 35*a* beneath the lip 33*c*. The slot 35*a* receives edge portion 29*a* of the rectangular slot 29 to hold one end of ribbon protector 23 in place on the cassette 11.

The rectangular slot 29 in ribbon protector 23 is longer than the stem portion 33*b* of the rectangular clip 33 to allow some lateral and back and forth movement of the ribbon protector 23 on rectangular clip 33. Rectangular slot 29 is shorter than head portion 33*a* with its lip 33*c*.

On the other ribbon guide arm 21 of cassette 11, a mushroom clip 37 is formed on front surface 21*a* and has a head portion 37*a* and a smaller stem portion 37*b*. Head portion 37*a* has an overhanging lip 37*c* which forms a circular slot 39 around stem portion 37*b* beneath the head portion 37*a* and this slot 39 receives the leaves 31*a* of starburst hole 31 to hold the other end of ribbon protector 23 in place on cassette 11.

Figure 2:
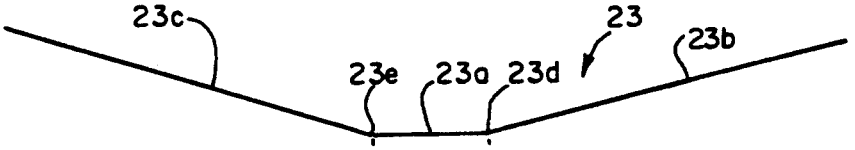
FIG. 2 is a view in top plan of the protector of FIG. 1.
Figure 3:
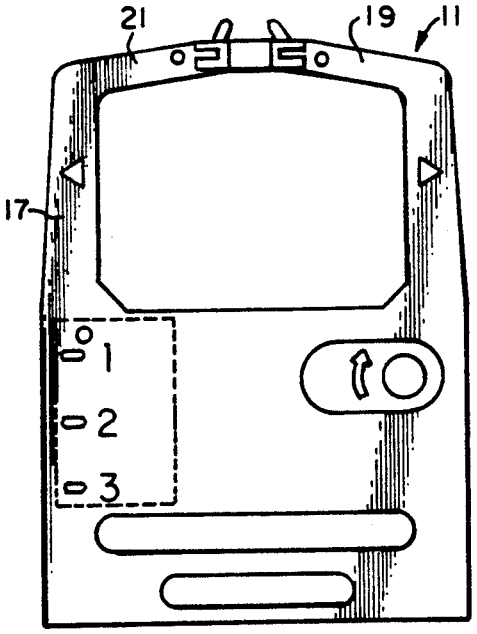
FIG. 3 is a view in top plan of a cover of a ribbon cassette constructed in accordance with this invention.
Figure 4:
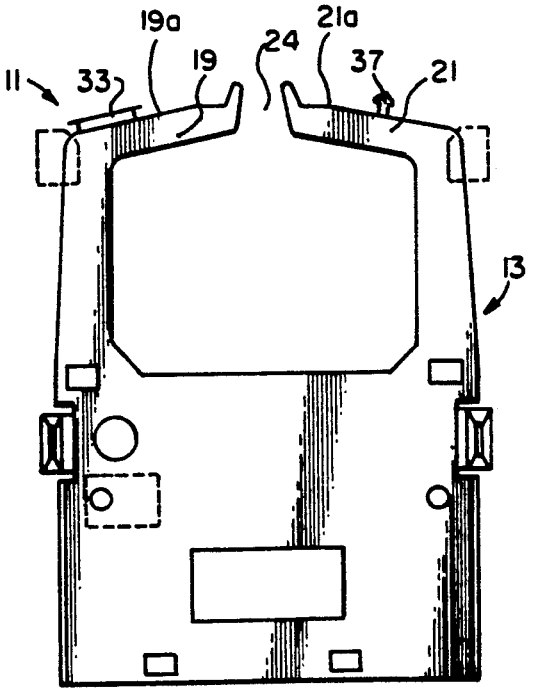
FIG. 4 is a view in bottom plan of the cassette of FIG. 3 and shows the bottom of the cassette case.

The ribbon protector 23 is adapted for detachable mounting on an ink ribbon cassette 11 to cover the exposed portion of the ribbon 15 as it is being passed between ribbon guide arms 19, 21. The protector 23 is elongated and is made from a sheet of resiliently bendable material, such as a sheet of polyester, and has a central portion 23*a*, an end portion 23*b* extending from one end of the central portion 23*a*, and another end portion 23*c* extending from the other end of central portion 23*a*. As shown in FIG. 2, the end portions 23*b* and 23*c* may be bent at crease lines 23*d* and 23*e* at an angle of about 15° from the central portion 23*a* for easier mounting on the arms 19, 21 of the cassette 11.

Central print hole 25 is formed in the central portion 23*a* of the protector 23 and provides access to the ribbon 15 for print head 27.

The rectangular slot 29 is formed in one end portion 23*b* and is adapted to slide over the rectangular clip 33 of cassette 11 and into slot 35*a* ribbon protector 23 on the cassette 11 and yet permit some lateral and back and forth movement of the ribbon protector 23.

The starburst hole 31 has leaves 31*a* and is formed in the other end portion 23*c* of the protector and snaps over the mushroom clip 37 to detachably hold the ribbon protector 23 on cassette 11 and to position the central print hole 25 in the central space 24 between the ribbon guide arms 19 and 21.

To mount protector 23 onto ribbon cassette 11, the rectangular slot 29 is hooked under lip 33*c* of rectangular clip 33, and then starburst hole 31 is pushed down over mushroom clip 37 so that its leaves 31*a* hook under lip 37*c* of the mushroom clip. This centers the protector 23 and central print hole 25.

Figure 5:
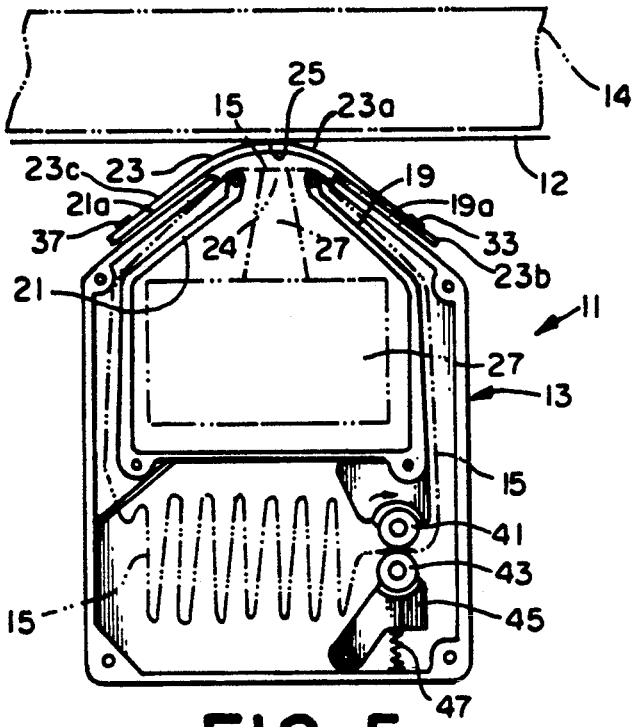
FIG. 5 is a view in top plan of the ribbon cassette with the cover off.
Figure 6:
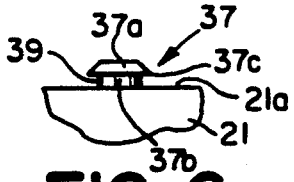
FIG. 6 is a view in side elevation of a mushroom clip on an enlarged scale.
Figure 7A:
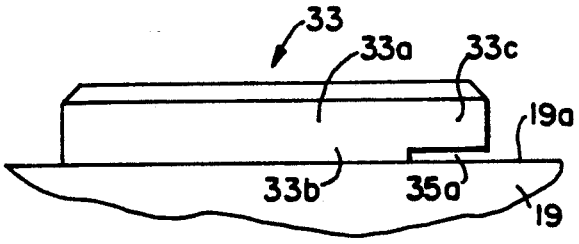
FIG. 7*a* is a view in side elevation of a rectangular clip on an enlarged scale.
Figure 7B:
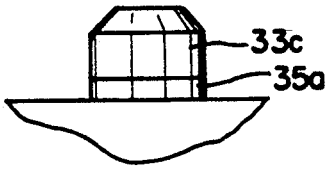
FIG. 7*b* is a view in end elevation of the rectangular clip of 7*a*.

FIG. 5 shows case 13 without cover 17 so that the interior of the cassette 11 can be seen with ribbon 15, ribbon guide arms 19 and 21, ribbon drive roller 41, and follower roller 43 with its support arm 45 which has a spring 47 connected to the wall of the case 13. The arm 45 and spring 47 urge the follower roller 43 against the drive roller 41.

I claim:

1. An ink ribbon cassette 11 for printing on a paper sheet 12, comprising a ribbon case 13 which houses an endless ink ribbon 15, a cover 17 mounted on the ribbon case 13, a pair of ribbon guide arms 19, 21 for guiding the ink ribbon 15 into and out of the ribbon case 13, ribbon guide arm 19 having a front surface 19*a* and ribbon guide arm 21 having a front surface 21*a*, an elongated ribbon protector 23 formed of a sheet of resiliently bendable material detachably mounted on the ribbon guide arms 19, 21 for covering an exposed portion of the ink ribbon 15 between the ribbon guide arms 19 and 21, a central print hole 25 formed in the central portion 23*a* of the protector 23 for positioning a print head 27 therein, a rectangular slot 29 formed in one end portion 23*b* of the protector 23, a starburst hole 31 having leaves 31*a* formed in the other end portion 23*c* of the protector 23, and means for positioning the ribbon protector 23 on the front surfaces 19*a*, 21*a* of ribbon guide arms 19, 21 and for detachably holding the ribbon protector 23 on front surfaces 19*a*, 21*a*, said means including a rectangular clip 33 formed on front surface 19*a* of ribbon guide arm 19 and having a head portion 33*a* and a smaller stem portion 33*b* with the head portion 33*a* having an overhanging lip 33*c* forming a slot 35*a* beneath lip 33*c* for receiving edge portion 29*a* of rectangular slot 29 to hold one end of ribbon protector 23 in place on cassette 11, the rectangular slot 29 being longer than the stem portion 33*b* of the rectangular clip 33 to allow some lateral and back and forth movement of the ribbon protector 23, and a mushroom clip 37 with a head portion 37*a* and a smaller stem portion 37*b* with the head portion 37*a* having an overhanging lip 37*c* forming a circular slot 39 beneath head portion 37*a* for receiving the leaves 31*a* of starburst hole 31 to hold the other end of ribbon protector 23 in place on cassette 11.

2. The ink ribbon cassette 11 of claim 1, the rectangular slot 29 being longer than the stem portion 33*b* of rectangular clip 33 and being shorter than the head portion 33*a* with its lip 33*c*.

3. A ribbon protector 23 for detachably mounting on an ink ribbon cassette 11, which houses a ribbon 15 and has ribbon guide arms 19, 21, to cover an exposed portion of the ribbon 15 as it crosses a central space 24 between ribbon guide arms 19 and 21, comprising an elongated sheet of resiliently bendable material, a central portion 23*a* in the sheet, an end portion 23*b* extending from one end of the central portion 23*a*, another end portion 23*c* extending from the other end of central portion 23*a*, a central print hole 25 formed in the central portion 23*a* of the protector 23, a rectangular slot 29 formed in one end portion 23*b* of the ribbon protector 23 for sliding over a rectangular clip 33 of cassette 11 to detachably hold one end of the ribbon protector 23 on the cassette 11 and yet permit some lateral and back and forth movement of the ribbon protector 23, and a starburst hole having leaves 31*a* formed in the other end portion 23*c* of the protector 23 for snapping over a mushroom clip 37 of cassette 11 for detachably holding the other end of the ribbon protector 23 on the cassette 11 and for positioning the central print hole 25 in a central space 24 between the arm 19 and 21 of the cassette 11.

* * * * *